United States Patent [19]

Price

[11] 4,097,202

[45] Jun. 27, 1978

[54] AUXILIARY COMPRESSOR ASSEMBLY

[76] Inventor: Billy Frank Price, 7752 Braniff St., Houston, Tex. 77061

[21] Appl. No.: 698,107

[22] Filed: Jun. 21, 1976

[51] Int. Cl.[2] ..... F04B 21/00; F04B 39/00; F16J 11/00

[52] U.S. Cl. ..... 417/454; 417/243; 92/171; 92/144

[58] Field of Search ..... 417/454, 273, 265, 254; 92/144, 171

[56] References Cited

U.S. PATENT DOCUMENTS

| | | | |
|---|---|---|---|
| 217,965 | 7/1879 | Waring | 417/254 |
| 1,321,792 | 11/1919 | Jackson | 92/144 |
| 1,331,111 | 2/1920 | Jones | 417/265 |
| 1,969,137 | 8/1934 | Karge | 92/144 |
| 2,255,851 | 9/1941 | Lundin | 417/273 |
| 2,464,560 | 3/1949 | Davey | 417/265 |
| 2,695,132 | 11/1954 | Paget | 417/254 |
| 2,941,475 | 6/1960 | Blair | 417/269 |
| 3,119,410 | 1/1964 | Noecker | 417/568 |
| 3,285,184 | 11/1966 | Dinnkelkamp | 417/273 |

FOREIGN PATENT DOCUMENTS

| | | | |
|---|---|---|---|
| 1,018,441 | 10/1952 | France | 417/568 |
| 1,251,436 | 12/1960 | France | 417/568 |

*Primary Examiner*—William L. Freeh
*Attorney, Agent, or Firm*—Pravel, Wilson & Gambrell

[57] ABSTRACT

An auxiliary compressor assembly for a conventional compressor having an auxiliary cylinder adapted to be releasably mounted with the conventional compressor and a head adapted to be removably mounted the auxiliary cylinder.

14 Claims, 2 Drawing Figures

AUXILIARY COMPRESSOR ASSEMBLY

BACKGROUND OF THE INVENTION

The field of this invention is compressors and compressor assemblies, particularly of the type for use in providing large volumes of high pressure compressible fluid.

In large compressors capable of providing large volumes of high pressure fluid, many require special cylinder-head arrangements, particularly for higher stages of compression. In many instances, very finely machined-intricately cast, one-piece cylinder-head assemblies are used which require not only special equipment for maintenance but also such assemblies require a very costly initial investment. Moreover, many of such units cause significant down-time delays due to the unavailability of replacement parts for these complicated arrangements in the event of malfunction. For example, should such an air compressor fail that is needed for seismic geologic sounding applications, particularly in parts of the world where adverse weather conditions result in very limited productive work periods, not only is a sizable investment in terms of ship, crew and the like made useless, but the entire procedure may have to be rescheduled for a significantly later time period due to a brief unavailability of parts to rectify the problem.

SUMMARY OF THE INVENTION

The present invention relates to a new and improved auxiliary compressor assembly which has an auxiliary cylinder adapted to be removably mounted on a conventional compressor with releasable mounting members and a head adapted to be removably mounted with the auxiliary cylinder by a releasable mounting member. In another aspect of the invention, the auxiliary cylinder head is formed having valving chambers to receive valve units for the intake and discharge of the compressible fluid, with the valve units being releasably secured in the head. Thus, this invention provides a quickly serviceable, inexpensive compressor assembly in which maintenance and replacement of the valve units is simplified as compared to the prior art.

DESCRIPTION OF THE PREFERRED EMBODIMENT

Figure 1:
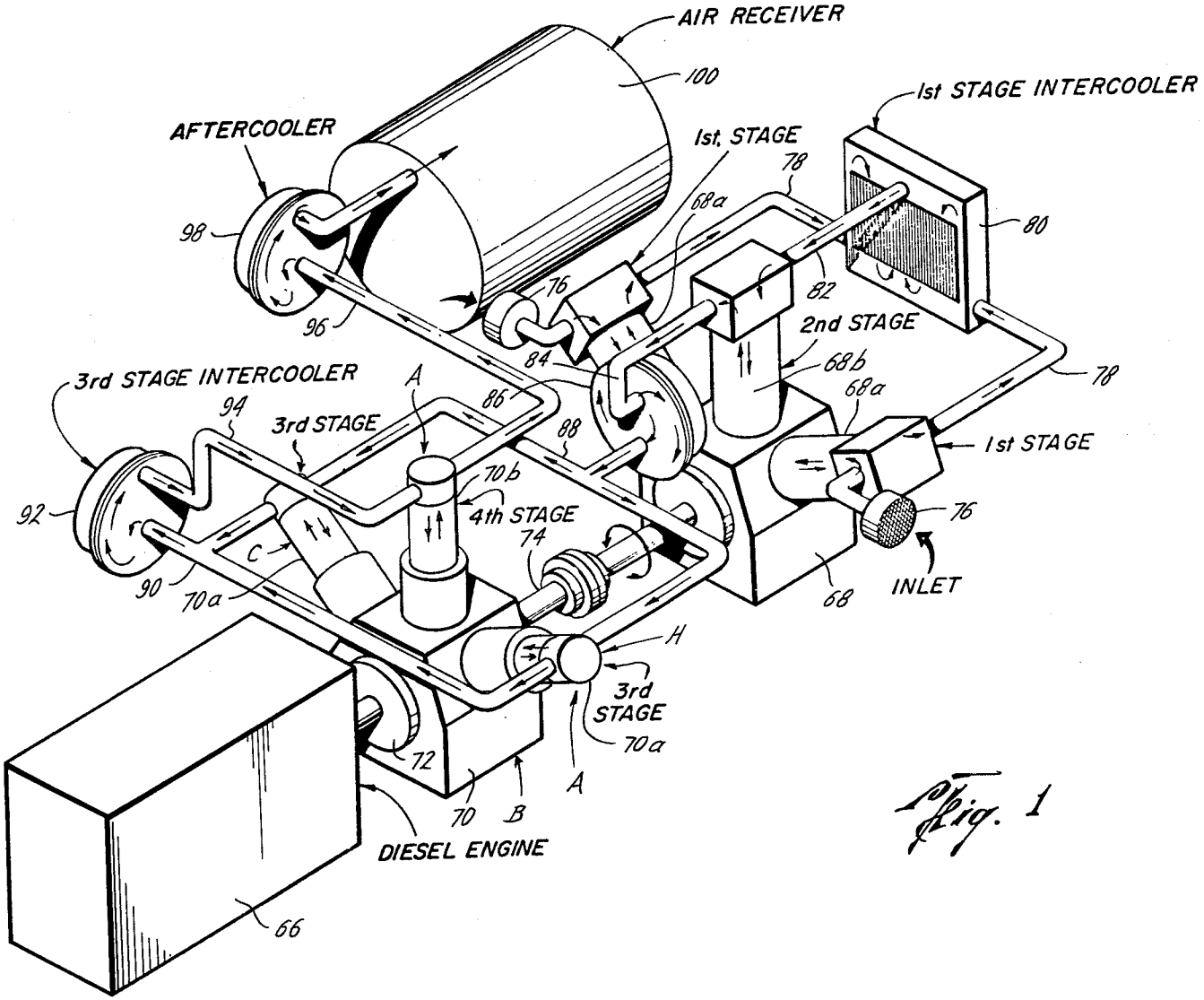
FIG. 1 is a schematic of a compressor system utilizing conventional compressor components in combination with the auxiliary compressor assembly of the present invention for providing large volumes of high pressure compressible fluid.

Referring to the drawings, the letter A designates the auxiliary compressor assembly of one embodiment of this invention. The auxiliary compressor assembly A is adapted to be used in conjunction with a conventional compressor B and includes an auxiliary cylinder C and a head H, with the auxiliary cylinder C adapted to be releasably mounted with conventional compressor B by releasable mounting means M and the head H further being releasably mounted with the auxiliary cylinder C by releasable mounting means M. Unless otherwise noted, components of this invention are made of steel or other suitable high-strength materials capable of taking the stresses and strains inherent in the operation of such a compressor.

Figure 2:
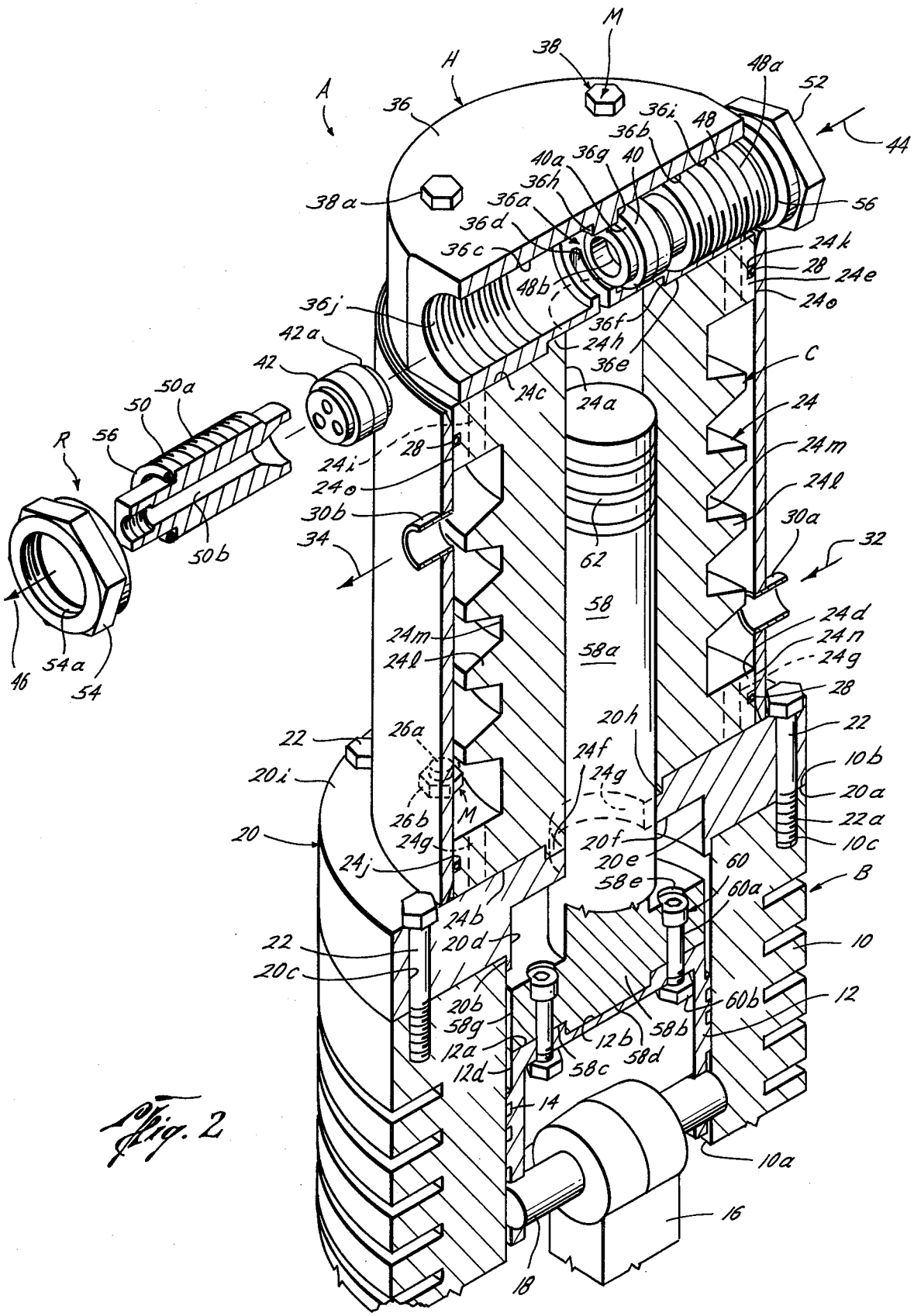
FIG. 2 is a sectional, isometric view of the auxiliary compressor assembly of the present invention.

As shown in FIG. 2, the auxiliary compressor assembly A of the present invention is adapted to be mounted on a conventional compressor B. Typically, such a conventional compressor B includes a conventional compressor cylinder 10 having a bore 10*a* therethrough. The bore 10*a* is adapted to receive a conventional compressor piston 12 mounted for reciprocal movement therein. Typically, piston rings 14 provide a suitable seal between the piston 12 and bore 10*a* of cylinder 10. Furthermore, the piston 12 is reciprocally movable within the bore 10*a* by a typical rodcrank assembly which is depicted in part in FIG. 2 as the upper portion of connecting rod 16 having wrist pin 18 movably mounted with connecting rod 16 and piston 12 to allow the appropriate reciprocal movement within bore 10*a* of the conventional compressor cylinder 10.

The auxiliary cylinder C of the auxiliary compressor assembly A of the present invention is adapted to be mounted with the conventional compressor B. The upper end surface 10*b* of the conventional compressor cylinder 10 is adapted to receivably mount a distance plate 20. The distance plate 20 includes a lower end surface 20*a* conforming substantially to that of upper end surface 10*b* of the conventional compressor cylinder 10 for engaging the same and further including a depending annular lip 20*b* adapted to extend into the bore 10*a* of the conventional compressor cylinder 10 for aligning the distance plate 20 with the conventional compressor cylinder 10. Suitable openings 20*c* are formed about the distance plate 20 and adapted to receive fasteners such as bolts 22 which are threadedly mounted with conventional compressor cylinder 10 by threads 22*a* engaging threaded openings 10*c* formed with the conventional compressor cylinder 10. Threaded openings 10*c* may be the existing openings for provisions for mounting a conventional compressor head (not shown) with the conventional compressor cylinder 10. Any suitable number of bolts 22 may be used to appropriately secure the distance plate 20 to the conventional compressor cylinder 10.

The distance plate 20 further includes a recess 20*d* formed centrally thereof distance plate 20 adjacent depending lip 20*b* with the lower end surface 20*a*. The recess 20*d* includes an annular surface 20*e* and an end surface 20*f*. A piston opening 20*g* is formed centrally of the distance plate 20 extending therethrough the distance plate 20 therebetween end surface 20*f* and recess 20*h* formed in the upper end surface 20*i* of distance plate 20. Depending lip 20*b* insures that the piston opening 20*g* is in proper axial alignment with the bore 10*a* of the conventional compressor cylinder 10.

The auxiliary cylinder C of the present invention is adapted to be mounted with the distance plate 20. The auxiliary cylinder C includes an auxiliary cylinder 24 having a bore 24*a* formed therethrough. The auxiliary cylinder 24 includes a first end surface 24*b* and a second end surface 24*c* formed at each end of the auxiliary cylinder 24. The first end surface 24*b* is preferably formed with flange 24*d* and second end surface 24*c* is formed with flange 24*e*, with each of such flanges 24*d*, 24*e* formed at each end of the auxiliary cylinder 24, respectively. Depending annular lip 24*f* is formed with the first end surface 24*b* and adapted to be receivably mounted in recess 20*h* formed with distance plate 20.

The first end surface 24*b* is secured to the distance plate 20 by releasable mounting means M. Such releasable mounting means includes plural fasteners 26 which may include a threaded stud 26a and nut 26b. Thus, flange 24d is secured to distance plate 20 by threaded stud 26a threadedly mounted (not shown) with distance plate 20 which extends through openings 24g formed in flange 24d with nut 24b appropriately securing flange 24d therewith distance plate 20. It should be noted that the openings 24g are shown schematically by dotted lines and have been revolved from their normal position for the purposes of illustration only.

Second end surface 24c and flange 24e are formed similar to first end surface 24b and flange 24d. More specifically, second end surface 24c includes a depending annular lip 24h and openings 24i, represented by dotted lines and revolved for purposes of illustration only. Any suitable number of openings 24g, 24i may be used, however, it is preferred that four such openings are well suited for the auxiliary compressor assembly A of the present invention.

Annular grooves 24j, 24k are formed with flanges 24d, 24e, respectively, and adapted to receive suitable sealing means such as O-rings 28, as will be discussed more fully hereinbelow. The auxiliary cylinder 24 further includes cooling fins 24l formed with the outer annular surface 24m of the auxiliary cylinder 24 for enhancing cooling of such auxiliary cylinder 24.

The auxiliary cylinder 24 is adapted to be bored multiple times to provide not only for various compression ratios which is a function of the bore but also an added reusability feature should the bore become scored in use. Inasmuch as flanges 24d, 24e are alike and provide unrestricted access to bore 24a, bore 24a may easily be aligned, machined, and reused.

It will be appreciated that the flanges 24d, 24e are substantially identical to one another having openings 24g, 24i in substantially identic positions as well as depending lips 24f, 24h being of near identic dimension. Preferably, openings 24g, 24i are symetrically disposed about the longitudinal axis of the auxiliary cylinder 24 on each flange 24d, 24e, respectively, with the openings 24g, 24i being substantially longitudinally aligned with one another to allow the auxiliary cylinder 24 to be mounted with the conventional compressor cylinder at selected rotational positions about the longitudinal axis of auxiliary cylinder 24. Furthermore, flanges 24d, 24f are preferably of substantially the same outside diameter.

A cooling jacket 30 is adapted to be mounted with and about the auxiliary cylinder 24 to provide for water cooling of the auxiliary cylinder 24 in environments where air cooling does not provide sufficient cooling as described more fully hereinbelow. The cooling jacket 30 is frictionally secured to annular end surfaces 24n, 24o of flanges 24d, 24e, respectively, by O-rings 28 appropriately disposed within grooves 24j, 24k. Cooling jacket 30 includes a suitable intake opening 30a and a suitable discharge opening 30b with the intake opening 30a adapted to receive cooling fluid such as water entering in the direction of arrow 32 for the cooling auxiliary cylinder C and thereafter being discharged through discharge opening 30b in the direction of arrow 34.

The auxiliary compressor head or more simply, the head H of the compressor assembly A of the present invention is adapted to be removably mounted on the second end surface 24c of flange 24e of the auxiliary cylinder 24. The head H includes head 36 having suitable openings (not shown) formed therein for receiving releasable mounting means M which includes fasteners 38 such as bolts 38a which are adapted to extend through such openings in head 36, through openings 24i in flange 24e of the auxiliary cylinder 24, and having a suitable nut (not shown) therewith for appropriately releasably securing the head 36 with the auxiliary cylinder 24.

The head is formed having a chamber, generally designated 36a, formed therein for receiving fluid to be compressed in the auxiliary cylinder 24 and discharging compressed compressible fluid from the auxiliary cylinder 24 through the head 36. The chamber 36a includes an intake valving chamber 36b and a discharge valving chamber 36c which are preferably axially aligned with one another substantially transverse to the longitudinal axis of bores 24a, 10a of auxiliary cylinder 24, conventional compressor cylinder 10, respectively. An inlet and discharge port 36d is formed therebetween intake valving chamber 36b and discharge chamber 36c through lower head surface 36e allowing communication with intake valving chamber 36b, discharge valving chamber 36c, and bore 24a of auxiliary cylinder 24. The port 36d is preferably of a slot-type configuration, however, any other suitable configuration may be alternatively used. A suitable recess 36f is formed in the lower head surface 36e to receive annular lip 24h of the auxiliary cylinder 24. End surfaces 36g, 36h are formed with valving chambers 36b, 36c, respectively, adjacent port 36d.

Valve means V is adapted to be removably mounted with the head H adjacent chamber 36a for regulating the intake and discharge of compressible fluid. The valve means V includes an intake valve unit 40 mounted in the intake valving chamber 36b for allowing the intake of compressible fluid in the direction of arrow 44 into the auxiliary compressor assembly A and for preventing discharge outwardly thereof and a discharge valve unit 42 mounted in the discharge valving chamber 36c for allowing discharge of compressible fluid from the auxiliary compressor assembly A and preventing intake of compressible fluid therethrough. Preferably, the valve units 40, 42 are of a spring-disc valve arrangement such as that manufactured by Texcentric Valve, Model No. 0911. The design of such valves 40, 42 is such that fluid flow is unidirectional through the valve and that such unidirectional flow will occur only after the preselected spring tension of the spring (not shown) in the valve is overcome, allowing fluid flow therethrough the valve. As such, the valve units 40, 42 act as one-way check valves insuring intake in the direction of arrow 44 and discharge in the direction of arrow 46 once the preselected spring tension of the valve is overcome. As shown in FIG. 2, the intake and discharge of the auxiliary compressor assembly A may be reversed by merely reversing the orientation of the end surfaces of the valve units 40, 42 within their respective chambers 36b, 36c, respectively.

The intake valve unit 40 is mounted within intake valving chamber 36b with surface 40a of valve unit 40 adjacent end surface 36g and discharge valve unit 42 mounted within discharge valving chamber 36c with surface 42a adjacent end surface 36h.

Releasable securing means R releasably secures the valve units 40, 42 with the head H to provide ease of maintenance and replacement of the valve units 40, 42. The releasable securing means R includes threaded valve cages 48, 50 and jam nuts 52, 54 for releasably securing intake valve unit 40 and discharge valve unit 42, respectively, with the head 36. Valve cages 48, 50 are each formed having threads 48*a*, 50*a* about their respective outer annular surfaces for threadedly engaging compatible threads 36*i*, 36*j* formed in valving chambers 36*b*, 36*c*, respectively. The valve cages 48, 50 cage or locate the valve units 40, 42, respectively, into position within the head 36. Jam nuts 52, 54 provide for final securing of valve cages 48, 50 and are preferably formed with internal threads such as threads 54*a* on jam nut 54 for receiving appropriate discharge line fittings (not shown). Preferably sealing means 56, which may be of any suitable sealing material such as teflon, rubber or the like, is disposed between the valve cages 48, 50 and jam nuts 52, 54 respectively, to prevent unwanted fluid migration of compressible fluid. Further, the valve means V allows appropriate single port intake and discharge of compressible fluid from the auxiliary compressor assembly A of the present invention.

The auxiliary cylinder C is adapted to receive an auxiliary piston 58 mounted with the conventional compressor piston 12. The auxiliary piston 58 includes an upper, elongate portion 58*a* adapted to be disposed within bore 24*a* of auxiliary cylinder 24 and reciprocally movable therein, and a lower disc portion 58*b* adapted to be connected to conventional compressor piston 12. The auxiliary piston 58 is preferably formed of cast aluminum, however, any other suitable material may be used.

The lower disc portion 58*b* includes a lower surface □*c* adapted to engage the upper surface 12*a* of piston 12 with stepped portion 58*d* engaging recess 12*b* formed in piston 12. The stepped portion 58*d* and recess 12*b* act to orient and align the longitudinal axis of the auxiliary piston 58 with that of bores 24*a*, 10*a*. The lower disc portion 58*b* is secured to piston 12 by fasteners 60 such as Allen headed bolts 60*a* which are recessed in recesses 58*e* formed in the lower disc portion 58*b* extending through openings 58*f*, 12*c* formed in lower disc portion 58*b*, piston 12, respectively, having a suitable threaded nut 60*b* for securing purposes. The outer annular surface 58*g* of the lower disc portion 58*b* is of a smaller diameter than bore 10*a* of conventional compressor cylinder 10 and is of slightly less diameter than annular surface 20*e* of distance plate 20 for allowing upper movement of the lower disc portion 58*b* into recess 20*d* at the uppermost part of the stroke of piston 12. Furthermore, it is preferred that the conventional compressor piston 12 be suitably machined preferably to the first piston ring groove to a diameter corresponding to that of outer annular surface 58*g* for providing a stepped portion 12*d* on piston 12. In practice, it is desired that the auxiliary piston 58 be attached to piston 12 with proper alignment being insured by recess 12*b* and stepped portion 58*d* and thereafter machining the combination auxiliary piston 58-conventional compressor piston 12 together resulting in substantially identic annular surfaces for surface 58*g* and portion 12*d* which may be received in recess 20*d* at the uppermost part of the stroke of piston 12.

The upper elongate portion 58*a* is formed with the lower disc portion 58*b* extending upwardly therefrom and therethrough piston opening 20*g* in distance plate 20 and bore 24*a* in auxililary cylinder 24. Piston rings 62 slidably seal the upper elongate portion 58*a* with the bore 24*a* of auxiliary cylinder 24. The upper elongate portion 58*a* moves reciprocally within the bore 24*a* of auxiliary cylinder 24 to provide for compressed compressible fluid as described more fully hereinbelow.

In the use or operation of the auxiliary compressor assembly A of the present invention, compressible fluid which may be any gas such as air, natural gas, or the like is drawn into the auxiliary compressor assembly A in the direction of arrow 44 upon downward movement of auxiliary piston 58. The auxiliary piston's downward movement results in a vacuum, which when is of sufficient magnitude to overcome the preselected spring tension in intake valve unit 40, results in the compressible fluid being drawn through the valve cage 48, intake valve unit 40, through port 36*d* into the bore 24*a* of the auxiliary cylinder 24. Upward movement of auxiliary piston 58 immediately causes the intake valve unit 40 to close with resultant compression of the compressible fluid within the bore 24*a*. The auxiliary piston 58 upward movement compresses the compressible fluid until the desired preselected pressure is obtained whereupon the discharge valve unit 42 opens allowing discharge of such compressed compressible fluid through such valve unit 42, valve cage 50 and outwardly therefrom head 36 in the direction of arrow 46. Thereafter, the auxiliary piston 58 again begins its downward movement until it draws a sufficient vacuum to overcome the spring tension in the intake valve unit 40 to open the same for again withdrawing compressible fluid into the bore 24*a* of the auxiliary cylinder 24.

It will be appreciated that inasmuch as flanges 24*d*, 24*e* are substantially identical, the auxiliary cylinder 24 may be reversibly mounted such that flange 24*e* may be mounted with the distance plate 20 and flange 24*d* may be mounted with the head 36. Further, due to the nature of the releasable mounting means M, the auxiliary cylinder 24 may be quickly and easily removed due to the ease in removing fasteners 26, 38. Furthermore, by use of bolts and nuts, the risk of shearing a fastener stud or projection within the auxiliary cylinder flanges 24*d*, 24*e* and/or the head 36 is effectively eliminated. Substantially identic depending annular lips 24*f*, 24*h* allow reversible mounting as well as ease in insuring aligned positioning of the auxiliary cylinder 24 with the conventional compressor B.

Preferably, the auxiliary cylinder C may be effectively cooled by means of air cooling in conjunction with its cooling fins 241. However, should the particular use and/or environment not allow for sufficient air cooling to provide and insure proper operating temperatures of the auxiliary compressor assembly A of the present invention, the cooling jacket 30 may be positioned about the auxiliary cylinder C in engagement with O-rings 28 to provide for appropriate forced fluid cooling, most typically, water cooling, once the appropriate connections are made with the intake opening 30*a* and the discharge opening 30*b*.

The releasable mounting means M as well as the interchangeable intake-discharge feature of the valve units 40, 42 provide for considerable ease in orientation of the connecting lines to and from the auxiliary compressor assembly A in multiple directions with the minimum amount of difficulty in doing the same. The releasable mounting means M in conjunction with openings 24*g*, 24*i* being in substantial longitudinal alignment as well as being substantially identically disposed about the flanges 24*d*, 24*e*, respectively, all adds to promoting this end result.

As schematically shown in FIG. 1, the auxiliary compressor assembly A of the present invention is adapted to be most useful in the "booster" stages of high pressure compressors. A typical high pressure compressor system may be powered by an appropriate prime mover 66 such as an electric motor or as shown, a diesel engine, which may be one such as that manufactured by General Motors, Model No. RC671. Such a prime mover 66 powers a primary compressor 68 and a booster compressor 70 by means of suitable couplings 72, 74.

The primary compressor 68 may be of any suitable design and may include those such as manufactured by Westinghouse Corporation, Model Nos. 3CD, 3CB, 3CDC. Typically, compressible fluid is drawn into the first stage 68*a* of the primary compressor 68 through inlets 76 at normal atmospheric pressure. Based upon a compression ratio of approximately 3.5 for the purposes of example only and not by way of limitation, the first stage 68*a* of the primary compressor 68 compresses and discharges air at approximately 52 psi into lines 78, whereinafter the heat from compression of the compressible fluid is removed preferably by first stage intercooler 80 which may be an air cooled radiator with a fan or any other suitable cooler. The cooled compressible fluid is then directed through line 82 into the second stage 68*b* of the primary compressor 68. With a compression ratio of 3.5, the resulting discharge of compressible fluid is at approximately 180 psi. It should be understood that it is desirable that the compression ratio for succeeding stages of any one compressor should be substantially the same inasmuch as uneven connecting rod stresses and loads may result in failure thereof. The discharge of second stage 68*b* is directed from line 84 into second stage intercooler 86 to again withdraw the heat of compression of the compressible fluid. The cooled compressible fluid is thereafter directed by means of lines 88 to the booster compressor 70. It should be understood that any type of means for providing compressible fluid at such a pressure to the booster compressor 70 may be used to effectively incorporate the auxiliary compressor assembly A of the present invention. Alternatively, the auxiliary compressor assembly A of the present invention may be used as the primary compressor but such is not preferred.

The booster compressor 70 is similar to the primary compressor 68, but includes the auxiliary compressor assembly A of the present invention mounted therewith. The compressed fluid is directed from lines 88 into the third stage 70*a* of booster compressor 70 wherein substantially 180 psi compressible fluid is compressed to 625 psi and directed outwardly therefrom through lines 90 into intercooler 92 for cooling the same. The cooled 625 psi fluid is directed through line 94 into the fourth and final stage 70*b* of booster compressor 70 as shown in FIG. 1 wherein the fluid is compressed to approximately 2,000 psi. Thereafter, it is discharged into line 96 for cooling through aftercooler 98 thereinto an air receiver 100 for storage thereof.

The intercoolers 86, 92 and aftercooler 98 may be of any type and/or variety suitable for removing large amounts of heat and capable of withstanding the pressure involved. Furthermore, by eliminating one of the third stage units 70*a* of the booster compressor 70 and by redirecting the lines and adding an additional cooler, the four stage system of FIG. 1 may be boosted to that of a five stage system with the resulting final discharge in excess of 6,000 psi. It should be appreciated that this sytem is designed for providing high volumes of high pressure compressed fluid and is adapted to receive through lines 88 compressed fluid at 180 psi at 200 scfm by way of example. By varying the bore 24*a* of the auxiliary cylinder 24 and the stroke of the auxiliary piston 58, many different compression ratios may be achieved. The compression ratio of 3.5 used in the hereinabove example is representative of compression ratios used in such compressor systems.

High pressure compressed fluid, particularly air, is extremely useful and is a necessary element for use with air guns used for seismic, geologic explorations in aquatic environments. Such applications as this result in use of such a system as shown in FIG. 1 on some type of an offshore exploratory vessel. In some parts of the world where adverse weather conditions prevail almost year round, only a very limited exploration period is available. Should a compressor fail that is being used for such an application, not only would losses be significant in terms of cost of the ship, crew and the like but also, time delays may be critical since a brief delay to secure replacement parts may cause a year's delay due to the severity of adverse weather conditions.

Many conventional compressors have intricate cylinder-head valving arrangement for their booster compressors due to the extremes in heat as well as thermal-mechanical stresses involved which do not lend themselves for ease of replacement and/or repair due to their requiring very sophisticated, special machinery for repairing the same. However, the auxiliary compressor assembly A of the present invention suffers not from these infirmities for the failure either of a valving unit 40, 42 or auxiliary cylinder 24, may be easily rectified in removal thereof and replacement in less than a half an hour's time. Furthermore, down time for a malfunctioning compressor may be reduced to a minimum because of the ease with which an entire head H-auxiliary cylinder C auxiliary compressor assembly A may be removed and replaced. Furthermore, should replacement parts be unavailable, the auxiliary cylinder C is adapted to be bored numerous times and/or reversed in order to keep a compressor operational during such critical operation periods when compressed fluid is a must during such limited working seasons. In many units wherein the valves-head-cylinder are of a one-piece construction, the likelihod of being able to repair this unit aboard a vessel is extremely limited due to the complicated casings requiring special equipment for alignment and boring whereas such is not the case with the auxiliary compressor assembly A of the present invention. Furthermore, due to the availability of the auxiliary cylinder 24 being bore multiple times, the compression ratio of the booster compressor may be easily changed to meet any demands necessary. The elimination of bolts going into the head and/or complicated valving structures helps to eliminate failures such as broken studs and/or threads in a unit which may render such an assembly ineffective or unrepairable within short time constraints necessary.

In addition to the ability to be used on offshore vessels in seismic geologic surveying, particularly in the most adverse of environments, the auxiliary compressor assembly A may be used with uncomplicated ease in compressing large quantities of gases such as low pressure natural gas. Much natural gas is presently available within capped off wells but is not of sufficient pressures to be commercially distributed. The auxiliary compressor assembly A of the present invention may be used to compress such low pressure gas to pressures necessary where it may be transmitted to other points for commercial uses.

Thus, the auxiliary compressor assembly A of the present invention provides a versatile, easily maintained, easily adaptable unit for providing large quantities of high pressure compressible fluid when used in combination with conventional compressors for a number of significant and important commercial purposes.

The foregoing disclosure and description of the invention are illustrative and explanatory thereof, and various changes in the size, shape and materials as well as in the details of the illustrated construction may be made without departing from the spirit of the invention.

I claim:

1. An auxiliary compressor assembly for use in providing large volumes of high pressure compressible fluid adapted to be mounted with a conventional compressor having a piston mounted for reciprocal movement in a cylinder, comprising:

an auxiliary cylinder having a bore formed therethrough;

said auxiliary cylinder having a first end surface and a second end surface formed at opposite ends of said auxiliary cylinder;

said auxiliary cylinder being positioned with said first end surface of said auxiliary cylinder mounted on and adjacent to the conventional compressor cylinder and with said bore of said auxiliary cylinder aligned with the bore of the conventional compressor cylinder;

a head removably mounted on said second end surface of said auxiliary cylinder;

said head having an intake valving chamber formed therein for receiving fluid to be compressed in said auxiliary cylinder and a discharge valving chamber formed therein for discharging compressed fluid from said auxiliary cylinder through said head;

valve means removably mounted with said head for regulating the intake and discharge of compressible fluid, said valve means including:

an intake valve unit mounted in said intake valving chamber allowing intake of compressible fluid into said auxiliary cylinder and preventing discharge outwardly thereof; and, a discharge valve unit mounted in said discharge valving chamber allowing discharge of compressed compressible fluid from said auxiliary cylinder through said head and preventing intake of compressible fluid therethrough;

said valve units reversible such that said intake valving chamber may act as said discharge valving chamber and said discharge valving chamber may act as said intake valving chamber upon respective reverse mounting of said intake valve unit in said intake valving chamber and reverse mounting of said discharge valve unit in said discharge valving chamber;

first releasable mounting means for releasably mounting said first end surface of said auxiliary cylinder with the conventional compressor cylinder; and, second releasable mounting means for releasably mounting said second end surface with said head.

2. The assembly of claim 1, wherein:

said intake valving chamber and said discharge valving chamber are axially aligned with one another to facilitate enhanced compressible fluid flow.

3. The assembly of claim 1, further including:

a first flange formed at one end of said auxiliary cylinder having said first end surface therewith; and, a second flange formed at the opposing end of said auxiliary cylinder having said second end surface therewith.

4. The assembly of claim 3, wherein:

said first flange and said second flange are substantially identical allowing reversible mounting of said auxiliary cylinder wherein said first flange may be removably mounted with the conventional compressor cylinder and said second flange may be removably mounted with said head.

5. The assembly of claim 4, wherein:

each of said flanges has openings formed therein for receiving said releasable mounting means wherein said openings are symetrically disposed about the longitudinal axis of said auxiliary cylinder on each of said flanges, said openings being substantially, longitudinally aligned for each of said flanges allowing said auxiliary cylinder to be mounted with the conventional compressor cylinder at selected rotational positions about said cylinder's longitudinal axis.

6. The assembly of claim 1, further including:

a cooling jacket adapted to be removably mounted with and about said auxiliary cylinder to provide for water cooling of said auxiliary cylinder in environments where air cooling does not provide sufficient cooling.

7. The assembly of claim 6, further including:

cooling fins formed with the outer annular surface of said auxiliary cylinder to enhance cooling of said auxiliary cylinder.

8. A high pressure compressor head assembly adapted to be releasably mounted with a high pressure compressor having compressing means therewith, comprising:

an auxiliary compressor head having a lower head surface which is adapted to be releasably mounted with the compressor;

said head having an intake valving chamber, a discharge valving chamber, and an inlet and discharge port formed through said lower head surface in communication with said intake valving chamber, said discharge valving chamber, and the compressing means of the compressor;

an intake valve unit mounted in said intake valving chamber allowing the intake of the compressible fluid into the compressor and preventing discharge outwardly thereof;

a discharge valve unit mounted in said discharge valving chamber allowing discharge of compressed compressible fluid from the compressor and preventing intake of compressible fluid therethrough;

said valve units are reversible such that said intake valving chamber may act as said discharge valving chamber and said discharge valving chamber may act as said intake valving chamber upon respective reverse mounting of said intake valve unit in said intake valving chamber and reverse mounting of said discharge valve unit in said discharge valving chamber; and, releasable securing means for releaseably securing each of said valve units with said heat to provide ease of maintenance and replacement of said valve units.

9. The compressor head assembly of claim 8, wherein:

said valving chambers are axially aligned with one another to facilitate enhanced compressible fluid flow.

10. The compressor head assembly of claim 8, wherein:

said valve units are one-way check valves.

11. The compressor head assembly of claim 8, wherein:

said intake valving chamber provides for single port intake; and, said discharge valving chamber provides for single port discharge.

12. The compressor head assembly of claim 8, wherein:

said reasonable securing means includes a valve cage for caging each of said valve units within each of the respective valving chambers.

13. The compressor head assembly of claim 12, wherein:

said releasable securing means further includes a jam nut for providing ease in maintenance.

14. The compressor head assembly of claim 13, further including:

sealing means adapted to be disposed between said valve cage and said jam nut to prevent unwanted fluid migration of said compressible fluid.

* * * * *